US006039121A

United States Patent [19]

Kisman

[11] Patent Number: 6,039,121

[45] Date of Patent: Mar. 21, 2000

[54] ENHANCED LIFT METHOD AND APPARATUS FOR THE PRODUCTION OF HYDROCARBONS

[75] Inventor: Kenneth Edwin Kisman, Calgary, Canada

[73] Assignee: Rangewest Technologies Ltd., Calgary, Canada

[21] Appl. No.: 08/919,534

[22] Filed: Aug. 28, 1997

Related U.S. Application Data

[60] Provisional application No. 60/038,113, Feb. 20, 1997.

[51] Int. Cl.[7] ..... E21B 43/24

[52] U.S. Cl. ..... 166/369; 166/372; 166/272.7; 166/62; 210/540

[58] Field of Search ..... 166/369, 372, 166/272.3, 272.7, 303, 54.1, 57, 62; 210/170, 747, 538, 540

[56] References Cited

U.S. PATENT DOCUMENTS

| | | | |
|---|---|---|---|
| 3,485,300 | 12/1969 | Engle | 166/265 |
| 4,344,485 | 8/1982 | Butler | 166/271 |
| 5,273,111 | 12/1993 | Brannan et al. | 166/245 |
| 5,413,175 | 5/1995 | Edmunds | 166/252 |
| 5,443,120 | 8/1995 | Howell | 166/265 |

FOREIGN PATENT DOCUMENTS 1304287 6/1992 Canada .

OTHER PUBLICATIONS

"Thermal Well Pumping Developments" by Wollen et al., 9th Annual Heavy Oil and Oil Sands Technical Symposium, Mar. 11, 1992.

"Simulation of Thermal Well Sucker Rod Pumping" by Wong et al., 64th Annual Technical Conference and Exhibition of the Society of Petroleum Engineers, Oct. 8–11, 1989, SPE 19714.

"Analysis of Thermal Well Pumping Performance at the Norcen–Bodo Steam Pilot" by Wong et al., Canadian Heavy Oil Association Thermal Well Completions Seminar, Aug. 11, 1988.

"Sceptre Tangleflags—Conversion of a Horizontal Thermal Producer to a Flowing Well" by Edmunds et al., CIM/SPE 3rd Annual Conference on Horizontal Wells, Nov. 15, 1993.

"Managing Artificial Lift" by Bucaram et al., 1994 Society of Petroleum Engineers, Distinguished Author Series.

"New and Expected Developments in Artificial Lift" by Lea et al., University of Tulsa Centennial Petroleum Engineering Symposium, Aug. 29–31, 1994, SPE 27990.

(List continued on next page.)

*Primary Examiner*—William Neuder
*Assistant Examiner*—Zakiya Walker
*Attorney, Agent, or Firm*—Sheridan Ross P.C.

[57] ABSTRACT extending into a hot subterranean hydrocarbon-bearing formation containing water at greater than 100° C. The wellbore is divided into three co-extensive passageways; an annulus, and first and second conduits. The annulus is formed within the wellbore between a block at its bottom above the completion intervals and an outlet at the wellhead. The first conduit extends from the formation, through the bottom of the annulus and to an outlet at an elevation intermediate up the annulus. The first conduit is insulated between the bottom of the annulus and its outlet. A second conduit extends between the bottom of the annulus and an outlet at the wellhead. In operation, by producing fluid from the annulus and the second conduit outlets at the wellhead, formation fluid is induced to rise up the first conduit. While the fluid rises, contained water flashes providing steam-enhanced lift. The now-cooled fluid flows out of the first conduit's outlet and into the annulus, separating into substantially gas-phase and liquid phase fluids which flow up and down the annulus respectively. The gas phase fluid is produced from the top of the annulus. Liquid-phase fluid pools in the bottom of the annulus may be artificially lifted through the second conduit using gas-lift or pumps for production at the wellhead outlet.

38 Claims, 4 Drawing Sheets

OTHER PUBLICATIONS

"Recommendations and Comparisons for Selecting Artificial–Lift Methods" by Clegg, et al., 1993 Society of Petroleum Engineers, Distinguished Author Series.

"Development and Implementation of Elan's Single Well SAGD" by Nzekwu et al., CHOA Conference on Heavy Oil: Opportunities and Optimism, Dec. 5, 1995.

"Development and Operation of a New Insulated Concentric Coiled Tubing String for Continuous Stream Injection in Heavy Oil Production" by Luft et al., SPE International Heavy Oil Symposium, Heavy Oil, Oil Sands, Thermal Operations, Jun. 19–21, 1995.

"A Comparison of Field Versus Forecast Performance for Phase B of the UTF SAGD Project in the Athabasca Oil Sands" by Mukherjee et al., 6th Unitary International Conference on Heavy Crude and Tar Sands, Feb. 12–17, 1995.

"The Gravity Drainage of Steam–Heated Heavy Oil to Parallel Horizontal Wells" by Butler et al., 31st Annual Technical Meeting of the Petroleum Society of CIM, May 25–28, 1980.

"The Nature and Control of Geyser Phenomena in Thermal Production Risers" by Edmunds et al., The Journal of Canadian Petroleum Technology, Jul. 27, 1995.

3
5
4
1
2
6
7
8
9
10
11
12
13
14
15
16
17
18
19
20
21
22
23
24
25
26
27
28
30
31
S
T
L

ENHANCED LIFT METHOD AND APPARATUS FOR THE PRODUCTION OF HYDROCARBONS

CROSS-REFERENCE TO RELATED APPLICATIONS

This application claims the benefits under U.S.C. §199(e) of U.S. provisional application Ser. No. 60/038,113, filed Feb. 20, 1997, which is incorporated herein by reference in its entirety.

FIELD OF THE INVENTION

The invention relates to apparatus and method for the separation of gas and liquid phases from formation fluid while in the wellbore. Further, the invention relates to apparatus and method for producing hot fluid containing water from a formation and producing gas and liquid at the surface. More particularly, heated heavy oil, formation water and condensed steam from a thermal well are produced, separated into gas and liquid in the well, the liquid being lifted to the surface using conventional artificial lift techniques.

BACKGROUND OF THE INVENTION

Viscous hydrocarbons, such as the Athabasca bitumen in Alberta, Canada, are challenging to recover from their subterranean formations. One successful recovery technique is Steam-Assisted Gravity Drainage ("SAGD"). Introduced in U.S. Pat. No. 4,344,485 to Butler, and described fully in the textbook *Thermal Recovery of Oil and Bitumen,* by Roger M. Butler, and published in 1991 by Prentice-Hall, Inc., SAGD is a thermal process for mobilizing viscous oils. Briefly, steam is injected from an upper well. Hydraulic communication is established between the upper well and a lower, horizontally extending production well. The steam forms a steam chamber. At the boundaries of the chamber, the steam condenses and heats the viscous oil, lowering its viscosity. The heated fluid (oil and condensed steam) drains downwardly, under the force of gravity, to the lower well. The heated fluid is produced from the lower well and is recovered at the surface.

The production of heated fluid is maintained on "steam trap control" such that the temperature of the fluid in the lower well must be maintained below the saturated steam temperature at that location. This ensures that steam doesn't break through to the oil-producing lower well.

If the steam chamber is operated at a sufficiently high pressure, the fluid flows naturally to the surface. This is called natural lift. Otherwise, if assistance is needed to get the fluid to the surface, artificial lift can be employed. Conventional artificial lift techniques include the use of pumps or gas lift, whereby gas is added to the fluid within the lower part of the well, at an elevation close to the heel of the horizontal well.

Artificial lift has often been especially problematic in thermal projects. If the operating pressure in the steam chamber is low relative to the depth of the well, gas lift may not be adequate. Lift pumps are disadvantaged due to high temperatures, the high fluid rates, the need for 'steam trap control', and because the water in the produced fluid readily flashes to steam during low pressure pump cycles, significantly reducing the pumping operating efficiency. One method of reducing flashing of steam is to use vertical production wells having sumps. A sump permits placement of the pump below the elevation of the formation. The hydrostatic head in the sump is correspondingly increased such that the heated fluid is considerably below its saturated steam condition when pumped, ensuring reasonable efficiencies.

Where the use of sumps is difficult or impractical, such as with SAGD having horizontal production wells, some of the water in the produced fluid flashes to steam inside the pump and the efficiency of the pump is drastically reduced. Flashing is further worsened because friction causes the fluid's pressure to drop along the horizontal well, approaching the heel portion where the pump would be located. This frictional pressure drop combined with heat transfer effects within the well may cause the fluid to be at saturated steam conditions prior to reaching the pump.

The SAGD process has been very successful in testing performed at an underground test facility ("UTF") located in the Athabasca oil sands in Northern Alberta. Fortunately, the formation at the UTF permits high enough pressures to be used to avoid the use of artificial lift. Other SAGD projects, such as those in the Peace River oil sand deposit, also in northern Alberta, need the assistance of and have successfully applied gas lift to achieve flow to surface.

In the largest oil sand deposit, the Athabasca oil sands, the oil-bearing payzone is frequently shallow or has gas or water sand thief zones which require the steam chamber pressure to be too low to provide adequate lift to the surface with standard gas lift. Flashing of water to steam, the elevated temperatures involved, and the high production flow rates effectively preclude the use of pumps.

Thus, providing an enhanced lift method capable of operation in these circumstances is an important addition to SAGD technology.

SUMMARY OF THE INVENTION

In one implementation of the invention, apparatus and method are provided for the enhanced lift of fluid from a wellbore completed into a hot subterranean formation. The wellbore extends downwardly from the wellhead and into the formation. Completion intervals admit formation fluid to the wellbore. A packer is located above the completion intervals, blocking flow of fluid up the wellbore. An annulus is defined within the wellbore, extending between the packing at the bottom and the wellhead at the top. The hot formation fluid contains water at a temperature greater than the saturated steam temperature at standard pressure conditions. At the bottom of the annulus, the pressure is at or above the saturated steam pressure. A first conduit extends from an inlet located in the formation, passes through the packer and up into the annulus. Intermediate the top and the bottom of the annulus, the first conduit is fitted with a port for fluid communication with the annulus. The first conduit is thermally insulated between the bottom of the annulus and the port. A second conduit extends downwardly from the top of the annulus to an elevation below the port.

In operation, and using the form of the apparatus described above, fluid is produced from the top of the annulus and from the top of the second conduit. These flows induce hot formation fluid to flow into and rise through the first conduit. As the formation fluid rises in the first conduit, the hydrostatic head on the fluid falls. At some point within the first conduit, the saturated steam pressure is reached and contained water begins to flash to steam. The port is located at an elevation higher than the point at which the contained water begins to flash. The steam aids in lifting the fluid through the first conduit to the port. At saturated steam conditions, the fluid temperature falls as the pressure falls, even if the enthalpy is constant, because the phase change of hot water into steam results in a lowering of temperature. Cooled fluid flows out of the port and into the annulus. The fluid separates into a substantially gas-phase fluid, which flows up the annulus, and a substantially liquid-phase fluid, which flows down the annulus to form a liquid pool. The thermally insulated section of the first conduit prevents cooling of the produced formation fluid rising within the first conduit and prevents re-heating of the cooled liquid-phase fluid falling in the annulus. The gas-phase fluid is produced at the top of the annulus and the liquid-phase fluid, which is drawn from the liquid pool, enters the bottom inlet of the second conduit and is produced at its top outlet. Gas-lift or a pump is preferably applied to the second conduit for artificially lifting the liquid-phase fluid from the liquid pool for production out of its top outlet.

It will be recognized that the apparatus and method described above for conducting fluid out of the wellbore is more broadly achieved by providing three parallel and co-extensive passageways. The three passageways act to admit fluid from the formation and to conduct gas and liquid-phase fluids for production at the wellhead.

More particularly, in a broad aspect, a method of producing fluid from a wellbore is provided, the wellbore extending downwardly from a wellhead and into a hot subterranean formation, the wellbore having completion intervals within the formation for admitting fluid, the formation fluid containing water at temperatures above 100° C., the steps comprising:

providing three passageways within the wellbore, the passageways having three parallel and co-extensive bores, the bore of the first passageway being blocked at its bottom above the completion intervals for blocking the entrance of formation fluid directly into the first passageway, and having an outlet at the wellhead, the bore of the second passageway being open at its bottom and in fluid communication with the formation for admitting formation fluid and having an outlet intermediate the bottom of the first passageway and the wellhead, the bore of the third passageway being open at its bottom and in fluid communication with the bottom of the bore of the first passageway for admitting fluid therefrom, and having an outlet at the wellhead;

flowing hot fluid from the formation upwardly through the bottom of the second passageway and into its bore;

elevating the hot formation fluid through the bore in the second passageway until the pressure of the formation fluid reaches the saturated steam pressure, causing contained water to begin to flash to steam and causing the fluid temperature to cool as the hot formation fluid continues to elevate and the pressure continues to fall;

discharging cooled formation fluid from the outlet of the second passageway and into the bore of the first passageway, where the fluid separates into a substantially gas-phase fluid which flows upwardly to the top of the first passageway's bore and substantially liquid-phase fluid which flows downwardly to establish a liquid pool in the bottom of first passageway's bore;

thermally insulating the cooled liquid-phase fluid flowing downwardly in the first passageway's bore from the hot formation fluid flowing upwardly in the second passageway's bore;

producing substantially gas-phase fluid from the top of the first passageway's bore; and lifting fluid from the liquid pool by conducting the fluid in the liquid pool up the bore of the third passageway to the wellhead so as to produce substantially liquid-phase fluid from the top of the third passageway's bore.

Preferably, the bore of the first passageway is formed by the bore of the wellbore. Further, the bore of the first passageway is blocked above the completion intervals with a packer for forming an annulus within the wellbore which extends between the packer at its bottom and the wellhead at its top. Further, the second passageway is preferably a conduit which extends from the formation, through the packer and up into the annulus. The second passageway's outlet is preferably a port formed in, and to permit flow into, the first conduit.

Preferably, production from the liquid pool is achieved by applying artificial lift; including gas-lift or pumps.

Further, it is preferable to control the rate of production of the fluid from the formation by adjusting the rate of production of fluid from either the top of the annulus or from the liquid pool. Optimally, the level of the liquid pool is then maintained at a level below the port. The level is controlled by adjusting the rate of production of fluid from the liquid pool or the top of the annulus, which ever is the opposing production location to that providing formation flow control.

More preferably, the production of formation fluid is controlled on steam trap control by first adjusting the rate of production from the formation to maintain the temperature of the entering formation fluid at a predetermined temperature below the saturated steam temperature. Further, the rate of production from the liquid pool is controlled to maintain the level of the liquid-phase fluid at a height below the port.

DETAILED DESCRIPTION OF THE PREFERRED EMBODIMENT

Figure 1:
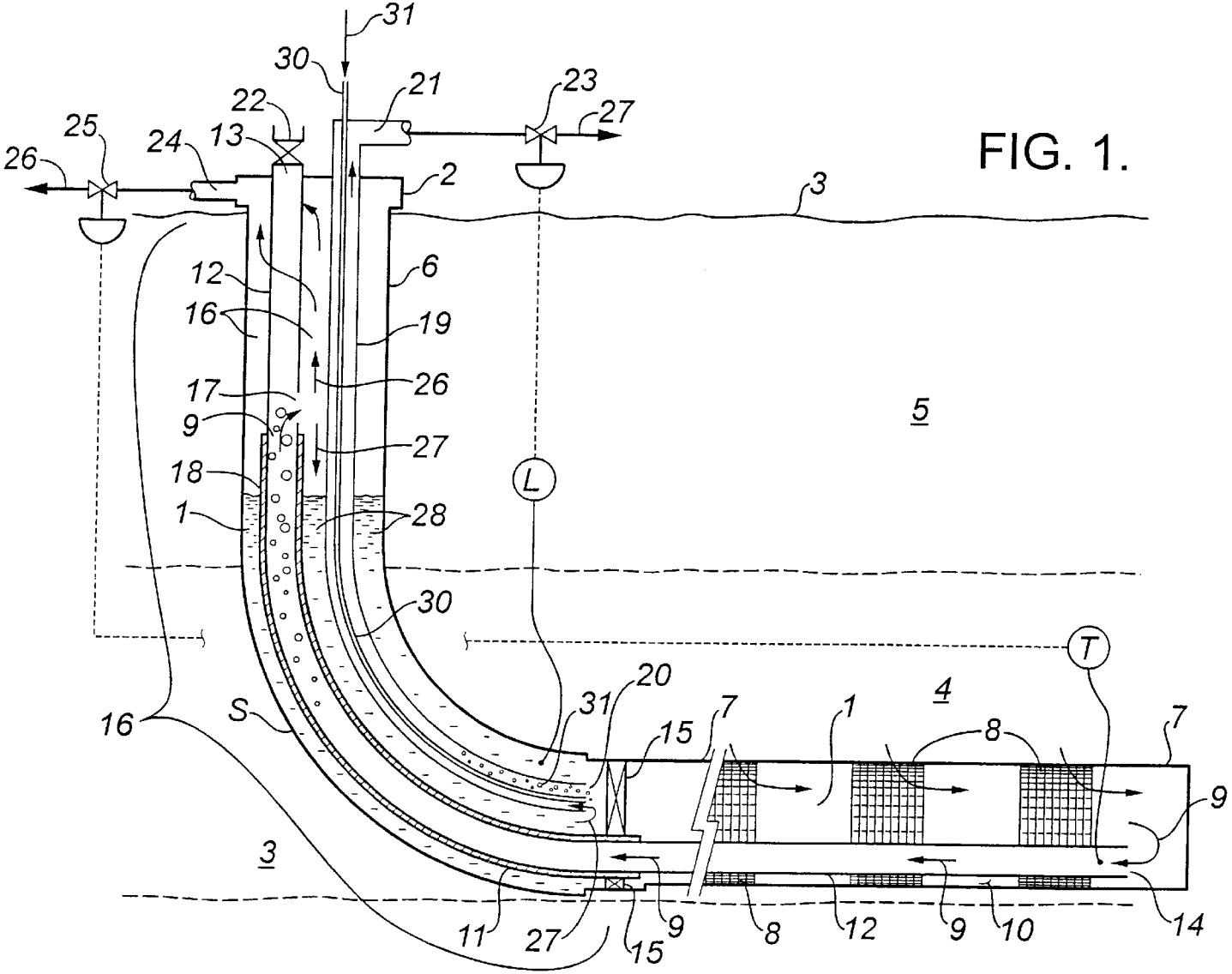
FIG. 1 is a cross-sectional schematic representation of a wellbore having a first conduit extending from a surface wellhead down to a bottom-hole packer, the annulus formed therebetween containing a second conduit in which gas lift is applied.

Having reference to FIG. 1, wellbore 1 extends downwardly from wellhead 2, located at the surface 3, and into a subterranean formation 4 which contains heavy oil or bitumen disposed beneath overburden 5. The wellbore 1 has a substantially vertical or deviated casing 6 terminating with a substantially horizontal well or liner 7 extending through the subterranean formation 4. The wellbore 1 is defined broadly herein as the space or bore extending within the casing 6 and liner 7, between the wellhead 2 and the end of the liner 7. The liner 7 has completion intervals 8, consisting of screens, slots or perforations, through which fluid 9 from the formation 4 flows to enter the wellbore 1. A horizontal production well tubing 10 conducts formation fluid out of the wellbore 1.

In a thermal recovery process such as SAGD, the formation fluid 9 is hotter than the boiling point of water (100° C.) at standard pressure conditions.

The hot formation fluid 9 contains water, which typically results from thermal recovery processes involving steam. The fluid 9 leaves the formation at near saturated steam conditions. The formation pressure may greater than the saturated steam pressure and thus suppress flashing; the contained water leaves the formation in a liquid phase. In other cases, the formation pressure may be at the saturated steam pressure and water begins to flash, forming steam. Additionally, by the time the fluid traverses the horizontal production well 10 and reaches the heel 11, frictional pressure drops and thermal transfer effects can cause the fluid to reach saturated steam conditions.

Regardless of conditions at the production well, as the fluid 9 is raised to the surface 3, the hydrostatic head diminishes, reducing the pressure in the fluid. Given the fluid's elevated temperature, the pressure falls to the saturated steam pressure. Thus, the water begins to flash to steam prior to reaching the surface 3.

In a first embodiment, a first tubing string or conduit 12 is installed in the wellbore 1. The bottom of the first conduit 12 is typically the horizontal production well tubing 10 of a SAGD process. The first conduit 12 has a top end 13 located at the wellhead 2 and a bottom inlet 14 located at any location along the liner 6 for accepting formation fluid 9.

A packer 15 is set in the wellbore 1, above the completion intervals 8. Packer 15 blocks formation fluid 9 from flowing up the wellbore 1. An annulus 16 is formed and is defined broadly as the open space within the wellbore 1 which extends between the wellhead 2 and packer 15. Wellhead 2 blocks fluid flow from the top of the annulus 16 at the surface 3. Packer 15 blocks fluid flow at the bottom of the annulus 16.

First conduit 12 passes from the wellbore 1 in the formation, through packer 15, and into annulus 16.

A discharge or port 17 is formed in the first conduit 12 and is located in the annulus 16. Port 17 enables formation fluid 9 to discharge from first conduit 12 and flow into the annulus 16. The elevation at which port 17 is located is dependent upon the characteristics of the fluid 9 and the available formation pressure, as described later.

First conduit 12 is fitted with thermal insulation 18 which extends substantially along its length between port 17 and packer 15. Typically, the first conduit is double walled, forming an annular space which contains insulation or a vacuum.

A second tubing string or conduit 19 is installed in the annulus 16. Second conduit 19 is located adjacent first conduit 12. Second conduit 19 has a bottom inlet 20 which terminates near the bottom of the annulus 16 and has a top outlet 21 which extends through wellhead 2.

Valve 22 blocks top end 13 of the first conduit 12. Choke 23 is fitted at the top outlet 21 of second conduit 19 for adjusting fluid flow therethrough. A fluid outlet 24 at the top of annulus 16 is fitted with choke 25 for adjusting fluid flow therethrough.

In operation, fluid is produced from the top of the annulus 16 and from the top outlet 21 of the second conduit 19. As a result, formation fluid 9 flows into the. bottom inlet 14 of the first conduit 12. The fluid 9 then rises up the conduit 12 to flow out of port 17 and into annulus 16.

Contained water in the formation fluid 9 is at, or is close to, saturated steam conditions at the elevation of the packer 15. As the fluid rises in the first conduit 12, the hydrostatic head diminishes, the pressure falls, and some of the water begins to flash to steam. Steam from flashing water, and any gas in the formation fluid 9, lowers the fluid's density. Thus, the steam-affected fluid 9 rises more easily to port 17; experiencing less hydrostatic back-pressure or head than if the fluid was entirely in the liquid phase. This phenomenon is conventionally referred to as gas or steam lift.

When the formation fluid 9 flows through port 17 and into annulus 16, it separates into a substantially gas-phase fluid 26 and a substantially liquid-phase fluid 27. The gas-phase fluid 26 flows up annulus 16 and is recovered at outlet 24. The liquid-phase fluid 27 flows downwardly to the bottom of the annulus 16, forming a liquid pool 28. The liquid-phase fluid 27 flows from the liquid pool 28 and into the bottom inlet 20 of the second conduit 19 to be artificially lifted therethrough for production at its top outlet 21.

The separation of the fluid 9 into gas and liquid phases 26, 27 occurs due in part to the large size of the annulus 16 and because there is split-flow of fluid 9 both up and down the annulus 16. To avoid back-pressure and to optimize the artificial lift process, the height of the liquid pool 28 is maintained just below the elevation of port 17.

The elevation of port 17 is chosen to meet several criteria.

Most importantly, port 17 must be above the elevation at which the contained water in the formation fluid 9 begins to flash. The flashing water provides steam lift and a mechanism for separating gas and liquid phases from the formation fluid 9.

Secondly and less importantly, should it be necessary for gas-phase fluid 26 to flow through choke 25 under its own energy, then port 17 must be low enough in the first conduit 12 so that sufficient pressure is present above the port. For example, should 200 kPa be required to drive gas through choke 25, and the pressure in the first conduit 12 at the elevation of the bottom of the annulus 16 is 800 kPa, then only 600 kPa is available to lift fluid 9 to the elevation of port 17. Steam lift assists in lifting fluid 9 to port 17. Alternatively, if surface equipment draws gas through choke 25, then less pressure is required in the annulus 16 and port 17 can be situated at a higher elevation.

The location of port 17 can be varied to optimise the lift performance under varying formation conditions. In some applications, the formation pressure will be highest early in the life of a well and natural lift is at its greatest. Accordingly, port 17 is best located in the upper part of the annulus 16. Later, as the formation pressure falls, another port (not shown) is formed at a lower elevation; the original upper port 17 being left open since it does not adversely affect lift performance. Initially, several ports can be provided, with means provided to open only one at a time. Such means include cutting successive ports, providing a tubular sliding sleeve assembly for each of a plurality of ports, and closing off ports using bridge plugs within the conduit.

The separation of gas and liquid-phase fluid 26, 27 from formation fluid 9, provides significant pressure and temperature advantages in preparing the liquid-phase fluid portion for recovery. First, the substantially liquid-phase fluid 27 in the liquid pool 28 has a higher density than the formation fluid 9 inside the first conduit 12 at corresponding elevations. Thus, the pressure at the bottom inlet 20 of the second conduit 19 is higher than at the corresponding elevation inside the first conduit 12.

Secondly, the temperature in the liquid pool 28 is less than that of the formation fluid 9. As stated above, when the formation fluid rises in the first conduit 12, the fluid pressure falls, saturated steam conditions are reached, and contained water begins to flash. While the water is flashing and the fluid continues to rise, the fluid pressure continues to fall. At saturated steam conditions, the fluid's temperature also falls as the pressure falls, and there is a phase change from hot water to steam to keep the enthalpy constant. Accordingly, as fluid 9 rises in the first conduit 12, its temperature falls; the resulting temperature of fluid 9 at port 17 being lower than it is at the first conduit's bottom inlet 14.

Thermal insulation 18 minimizes heat transfer between the upwardly flowing, hot formation fluid 9 in the first conduit 12 from the cooler liquid-phase fluid 27 flowing downwardly in the annulus 16. This thermal break serves two purposes. First, the enthalpy of the formation fluid 9 flowing up the first conduit 12 is kept substantially constant for: maximising the flashing of hot water to steam; maximising steam lift; and maximising the height to which the fluid will rise under the pressure in the formation 4. Secondly, liquid-phase fluid 27 flowing downwardly in the annulus 16 is not re-heated by the hotter formation fluid 9 inside the first conduit 12 for: preventing flashing of residual hot water which would reduce the density of the liquid-phase fluid 27; and disadvantageously reducing the pressure at the bottom inlet end 20 of the second conduit 19. Further, high temperatures are disadvantageous should a pump be applied in the second conduit 19.

Ideally, the temperature of the liquid-phase fluid 27 diminishes even further due to heat loss through the casing 6 to the overburden 5.

In summary, in contrast to the condition of the formation fluid 9 in the first conduit 12 at corresponding elevations, the fluid in the liquid pool 28 is: substantially in the liquid phase; is more dense; is at a higher pressure; is at a lower temperature; and is therefore more amenable to the application of conventional forms of artificial lift, including gas lift and pumps.

To control the production of fluid 9 from the formation 4, the gas-phase fluid 26 is produced and controlled through choke 25 at the top outlet 24 of annulus 16. Further, liquid-phase fluid 27 is lifted through second conduit 19 and is produced through choke 23 at the top outlet 21. As a result, formation fluid 9 flows into the bottom inlet 14 of the first conduit 12.

The rate of production of formation fluid 9 is controlled by either controlling the rate of gas-phase flow or liquid-phase flow. If the rate of production of the gas-phase fluid 26 controls the rate of production of formation fluid 9, the rate of production of liquid-phase fluid 27 controls the level of the liquid pool in the annulus 16. The converse control scheme may also be practised. In SAGD operations, it is possible that the production rate is so stable that the control rates of gas-phase and liquid-phase fluid may be determined empirically and are not necessarily dynamically adjusted.

The preferred method of controlling the production of formation fluid 9 is to control the formation fluid production rate in response to formation fluid temperature and to control the level of the liquid pool in the annulus.

First, in a process similar to steam trap control in a SAGD process, the flow of gas-phase fluid 26 from the wellhead 2 at the top 24 of the annulus 16 is controlled through choke 25 so as to maintain a predetermined temperature T in the fluid produced from the formation 4. The temperature set point T is maintained a selected a number of degrees below the saturated steam temperature at the resident pressure conditions, or a selected number of degrees below the temperature in the horizontal injection well. The gas-phase fluid is produced at a maximal rate without exceeding the set point temperature T, risking steam breakthrough or interfering with steam lift.

Second, the flow rate of liquid-phase fluid 27 from the top outlet 21 of the second conduit 19 is controlled using choke 23 so as to maintain a predetermined liquid level L of, the liquid pool 28 in the annulus 16. Optimally, the pool's liquid level L is maintained just below port 17.

The converse control scheme is equally preferred, wherein the pool's liquid level L is controlled via gas-phase fluid flow control and the temperature of the fluid produced from the formation is controlled through liquid-phase fluid flow control.

The liquid level L of the pool 28 is determined from the difference in fluid pressure between the pressure at a known location below port 17, preferably adjacent the bottom of the annulus 16, and the pressure in the gas at the top of the annulus 16. The pressure in the liquid-phase fluid 27 is determined using a bubbler tube or pressure sensor (not shown) which terminates at a known elevation within the liquid pool 28. The bubbler tube is installed through the second conduit 19 or through the annulus 16.

Accordingly, in one embodiment, if the pressure in formation 4 is sufficiently high, conventional gas lift can be practised on the liquid-phase fluid 27 in the liquid pool 28.

More particularly, as shown in FIG. 1, gas lift conduit 30 is shown installed into the second conduit 19 for injecting a non-condensable gas 31 such as natural gas or nitrogen. The gas 31 enters the liquid-phase fluid 27 near the bottom inlet 20 of the second conduit 19. The lower the elevation at which gas 31 enters the fluid 27, the greater is the resultant lift effect. Gas 31 provides lift by lowering the density of the fluid 27. Optionally, more elaborate gas lift techniques such as gas lift valves (not shown) may be used. Knowing the characteristics of the fluid and the dimensions of the conduit, those skilled in the art can readily calculate the parameters necessary to perform gas lift.

Figure 2:
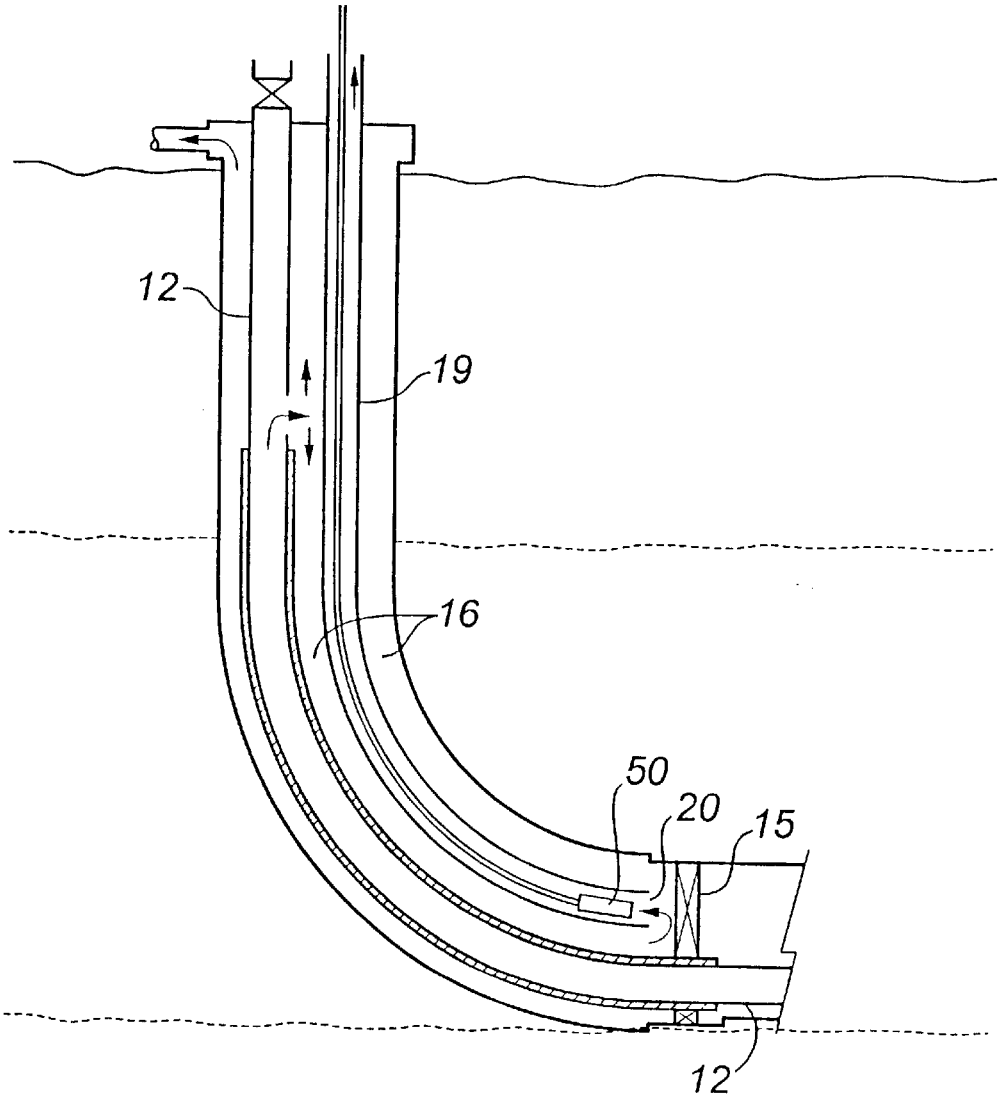
FIG. 2 is a cross-sectional schematic representation of the well as shown in FIG. 1., the second conduit applying a pump instead of gas-lift.

In another embodiment as shown in FIG. 2, a down-hole pump 50 can be operated in the second conduit 19. Pumps operate more efficiently at higher pressures, at lower temperatures, and with fluid at conditions considerably below the saturation pressures and temperatures of contained water. Further, the resultant temperature may be low enough to operate an electric submersible pump.

Figure 3:
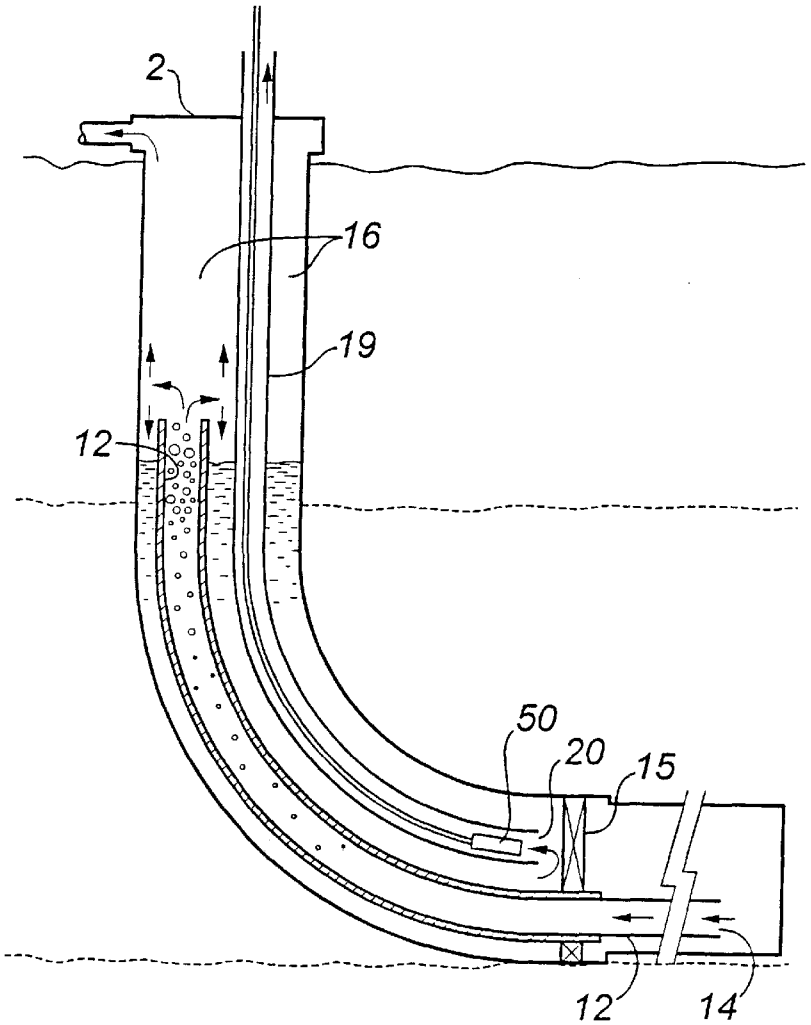
FIG. 3 illustrates an alternate embodiment of the apparatus, illustrating a first conduit which does not extend to the wellhead.

In another embodiment, as shown in FIG. 3 and as described above, the first conduit 12 need only extend upwardly from its inlet 14, through the packer 15 and to terminate at the port 17; and not to wellhead 2. Accordingly, in contrast to the arrangement depicted in FIGS. 1 and 2, means (not shown) may be employed to initially install the first conduit 12 through packer 15. The installation means is then subsequently removed.

Figure 4:
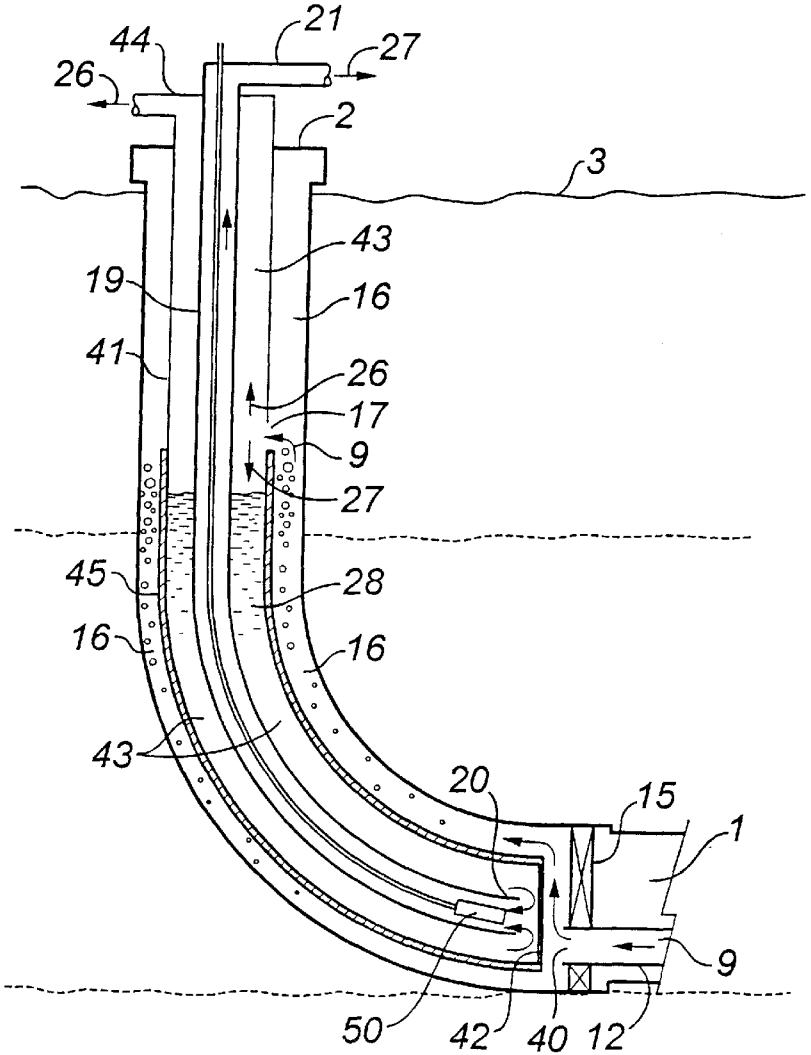
FIG. 4 illustrates an alternate embodiment of the apparatus wherein the second liquid-phase fluid producing conduit is concentrically installed within a large diameter tubing to form a phase separation annulus therebetween.

In yet another embodiment, and having reference to FIG. 4, rather than installing the second conduit 19 in annulus 16, adjacent the first conduit 12, it may be installed in an alternate and concentric arrangement. New reference numerals are employed where the embodiment differs from that described above.

First conduit 12 extends only a short distance above packer 15 to new outlet 40. The first conduit 12 discharges fluid from outlet 40 into annulus 16. A new large diameter tubing 41 extends down annulus 16 from the wellhead 2 to an elevation adjacent the bottom of the annulus 16. Tubing 41 is closed at its bottom 42. Port 17 is now formed in tubing 41 at an elevation determined as described above. The second conduit 19 extends downwardly, from its outlet 21 at wellhead 2, and concentrically within tubing 41 to terminate at an elevation near the tubing's closed bottom 42. An inner annulus 43 is formed between the second conduit 19 and the tubing 41. The tubing 41 has an outlet 44 at the top of the inner annulus 43. Tubing 41 has thermal insulation 45 disposed along its length between its closed bottom 42 and port 17.

In operation, fluid is produced from the inner annulus's outlet 44 and from the second conduit's top outlet 21. Consequently, formation fluid 9 flows out of the first conduit's outlet 40 and into annulus 16. The fluid 9 rises through annulus 16 and then flows through port 17 into the inner annulus 43 where it separates into substantially gas-phase 26 and substantially liquid-phase fluid 27. The gas-phase fluid 26 is produced at outlet 44 of the inner annulus 43, and the liquid-phase fluid 27 flows down the inner annulus 43 to form a liquid pool 28 at the inlet 20 of the second conduit 19 where it is artificially lifted to the surface 3.

In summary, it is clear that the provision of first and second conduits and an annulus in one embodiment and second conduit, an inner annulus and an outer annulus in another embodiment are merely variations for providing three parallel and coextensive passageways into which formation fluids are admitted and substantially gas-phase and liquid-phase fluids are produced.

Figure 5B:
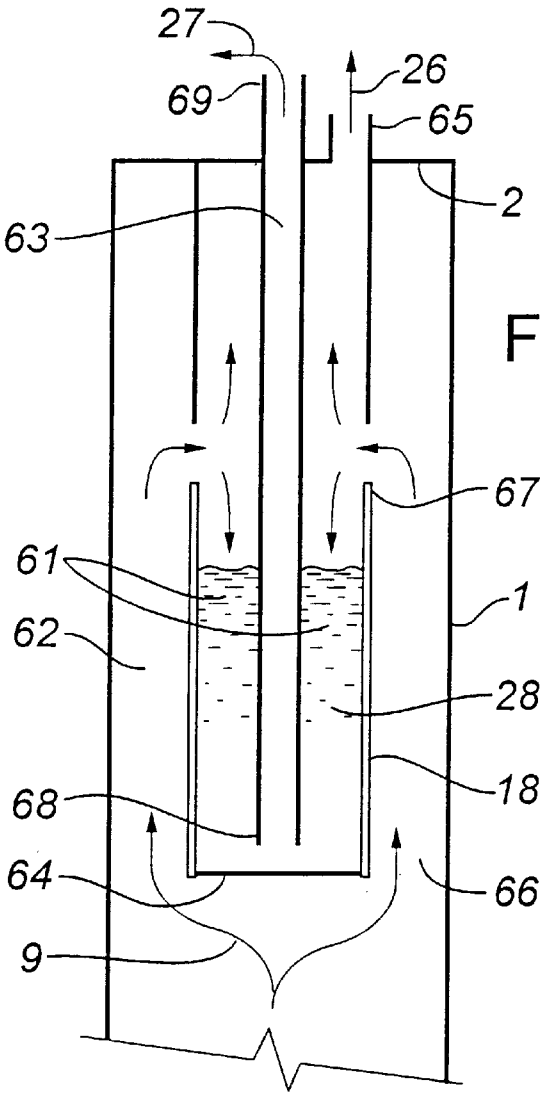
FIGS. 5*a* and 5*b* illustrate simplified schematics of the embodiments depicted in FIGS. 1 and 4 respectively.
Figure 5A:
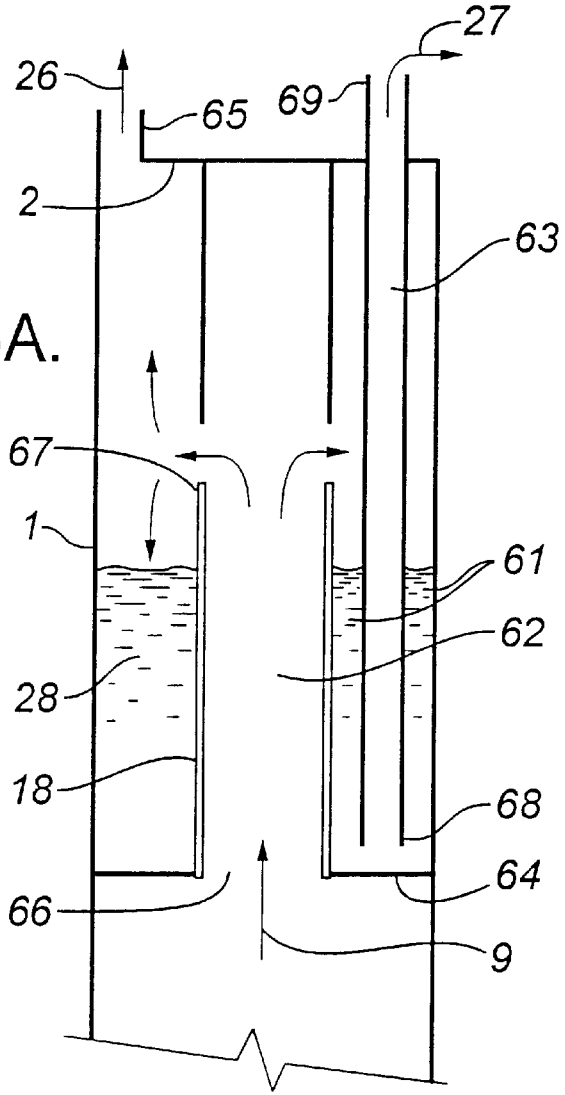

Having reference to the schematic FIGS. 5*a* and 5*b*, this relationship is simply illustrated. FIGS. 5*a* and 5*b* are schematic representations of the embodiments depicted in FIGS. 1 and 4 respectively.

Three passageways 61, 62, 63 are provided within the wellbore 1. The passageways have three parallel and co-extensive bores. The bore of the first passageway 61 is blocked at its bottom 64 above the completion intervals (not shown) and has an outlet 65 at the wellhead 2. The bore of the second passageway 62 is open at its bottom 66 for admitting formation fluid 9 and has an outlet 67 intermediate the bottom 64 of the bore of the first passageway and the wellhead 2. The bore of the third passageway 63 is open at its bottom 68 and is in fluid communication with the bore of the first passageway 61 for admitting fluid therefrom, the bottom 68 being located at an elevation below the second passageways's outlet 67. The bore of the third passageway also has an outlet 69 at the wellhead 2. Thermal insulation 18 between the second and first passageways, and extending from the bottom 64 of the bore of the first passageway 61 to the outlet 67 of the second passageway 62, thermally isolates fluid flows in the first and second passageways 61, 62.

In operation, hot formation fluid 9 flows upwardly through the second passageway 62. In a process described previously, contained water begins to flash and the fluid cools. The cooled fluid 9 discharges from outlet 67 of the second passageway 62 and flows into the bore of the first passageway 61, where it separates into a substantially gas-phase fluid 26, which flows upwardly to the top of the first passageway 61, and substantially liquid-phase fluid 27, which flows downwardly to establish a liquid pool 28 in the bottom 64 of the first passageway 61. Gas-phase fluid 26 is produced from outlet 65 at the top of the first passageway's bore. Liquid-phase fluid 27 is lifted from the liquid pool 28 through the third passageway 63 and is produced at outlet 69.

EXAMPLE

A SAGD pilot utilizing an embodiment of the present invention is being implemented in the McMurray Formation of the Athabasca Oil Sands deposit. The conditions set forth in the following example are similar to those conditions expected in the pilot, but do not necessarily represent the final completion and operation of a production well in the pilot.

The lower production wells will be at a depth of about 367 m. The formation at the pilot comprises a 50 m thick oil sand deposit, but also has a 13 m thick thief zone of water and gas sands directly above the pay zone. The pressure in the thief zone is only about 850 kPa. Accordingly, because of the low pressure thief zone, the steam injection pressure will have to be correspondingly reduced to close to 850 kPa once the steam chamber rises to the overlying thief zone.

The performance of a production well in the pilot was simulated using a thermal wellbore simulator, Qflow, developed by Fractical Solutions Inc., Calgary, Alberta. The produced fluid is assumed to comprise 100% water and no oil. Note that the density of the bitumen for this pilot study is very nearly that of water. The addition of bitumen will change the results somewhat, but the trends will be similar.

First and second conduits are arranged as depicted in FIG. 1. A first conduit 12 having an inner diameter of 76 mm is used. The simulated steam zone pressure is 900 kPa, and the production flow rate of formation fluid 9 is 150 $m^3$/d. The subcool temperature of the fluid at the inlet 14 of the first conduit 12 is 5.0° C., which means that the temperature is 170.1° C. compared to the saturated steam temperature of 175.1° C. for a pressure of 900 kPa at that location. The first flow region is the along the horizontal well starting from the toe at the end of the well and extending a distance of 470 m to the packer 15 which is taken to be the heel of the horizontal well. The heel of the horizontal well is 6 m above the elevation of the toe of the well. The simulator predicts that the pressure in the first conduit 12 at the heel of the horizontal well will be 838 kPa and the temperature of the fluid 9 will be 170.2° C., which is a subcool of 2.0° C. (Note that the fluid at the heel of the well could be at saturated steam conditions if a smaller subcool temperature were used at the toe of the well, or if the horizontal well were longer as planned for commercial applications.)

The second flow region extends up the first conduit 12 from the heel of the horizontal well to the port 17. With the elevation of the port 17 being 144 m above the elevation of the packer 15, the pressure of the fluid at the port 17 is predicted to be 386 kPa as a result of steam lift of the fluids in the first conduit 12. The temperature of the fluid in the first conduit 12 falls to 142.3° C. at port 17 (since 142.3° C. is the saturated steam temperature at 386 kPa). The resultant formation fluid at port 17 has a flowing composition of 88% gas phase by volume, and has a fluid density only about 12% of that of the liquid-phase fluid at the heel of the horizontal well, although the mass ratio of steam to liquid is only 5.5%. The fluid exiting the port 17 splits into a gas phase consisting of 8.2 m3/d (cold water equivalent) steam which flows to the top outlet 24 at the top of the annulus 16, and 141.8 m3/d of liquid which flows down the toe of the second conduit 19.

The third flow region extends in the annulus from the port 17 down to the toe of the second conduit 19. Assuming that the liquid level in the annulus 16 is at the elevation of the port 17, the hydrostatic head of the liquid at the elevation of the toe of the second conduit 19 is about 1305 kPa. Including the pressure of 386 kPa in the gas phase 26 above the liquid phase 27 in the annulus, the total pressure at the toe of the second conduit 19 is about 1691 kPa. Frictional pressure drops in the annulus 16 are considered to be very small. The temperature of the liquid-phase fluid 27 remains at about 142.3° C., due to thermal insulation 18.

The fourth flow region extends up the second conduit 19 from the toe to the surface. By injecting 7000 $sm^3/d$ of natural gas into the second tubing string at the toe by means of a 25.4 mm gas lift string 30 inside the 88.9 mm (outer diameter) second tubing string 19, 141.8 $m^3/d$ of liquid-phase fluid 27 is lifted 359 m to the surface 3 with a resulting surface pressure of 577 kPa. The temperature of the lifted fluids inside the second tubing string is expected to remain dose to the value 142.3° C. because the liquid and gas phases in the annulus are at approximately this temperature all the way up the annulus. The natural gas used to lift the fluids can be separated and used to generate the steam used in the thermal recovery process.

The above simulation results for gas lift using the method of this invention may be compared to lift based on steam lift, or steam plus gas lift, in the first tubing string for the same conditions, tubing size and gas lift rate. Whereas, in the above example, the method of this invention achieves a pressure of 577 kPa at the surface, steam lift in the first tubing string 12 cannot lift the fluids to the surface. If 7000 m3/d of gas lift is added to the steam lift in the first tubing string 12, the pressure at the level of the port 17, which is 230 m from the surface, is increased from 386 kPa to only 507 kPa, and the fluid pressure falls to less than 100 kPa at a depth of 100 m from the surface. Optimization of the tubing size and gas flow rate in the model will improve the performance of steam plus gas lift somewhat, likely at the expense of flow stability, but the method of this invention can also be improved in the model by optimizing the height of the port, the tubing sizes, and the gas flow rate.

Alternately, as per FIG. 2, if a bottom-hole pump 50 is used in the second conduit 19, it need only withstand 142.3° C. using the method of this invention instead of 173.0° C., and it should operate with good efficiency because the temperature is 62° C. below saturated steam conditions at the pressure 1691 kPa at the second conduit's inlet 20. The higher pressure of 1691 kPa at the pump 50, compared to only about 838 kPa at the same elevation in the first conduit 12, also increases the efficiency of the pump 50.

As identified in the background of the invention, rod-driven pumps suffer wear while operating in a near horizontal orientation. If the pressure at the bottom inlet 20 of the second conduit 19 is sufficiently high, the pump 50 can be landed at a higher elevation where the orientation of the conduit 19 is more vertical.

Various changes and enhancements are apparent to those skilled in the art, several of which are described as follows.

For instance the invention is applicable to both vertical and horizontal wells.

Conventional gas lift techniques (such as a gas delivery conduit—not shown—extending down the first conduit) can also be added to the first conduit 12 to enhance the steam lift and provide flexibility in the positioning of port 17. Additional gas lift applied to the first conduit 12 can: enable port 17 to be situated even higher; provide a factor of safety should the port be positioned too high for steam lift alone; assist in startup of fluid flow before flashing provides adequate lift; or aid in stabilizing fluid flow up conduit 12.

In the embodiment shown in FIG. 4, a larger volume can be provided for the separation of gas and liquid phases by using the both the outer and inner annuluses above the port. Additional openings are provided through the conduit 41, above the port to couple the inner and outer annuluses, or the tubing 41 is suspended in the wellbore as shown for conduit 12 in FIG. 3. Optionally, using means, such as a flow restriction device attached to the outside of the tubing 41 just below the port, liquids are prevented from flowing back down the outer annulus and instead are diverted into the inner annulus.

Figure 6:
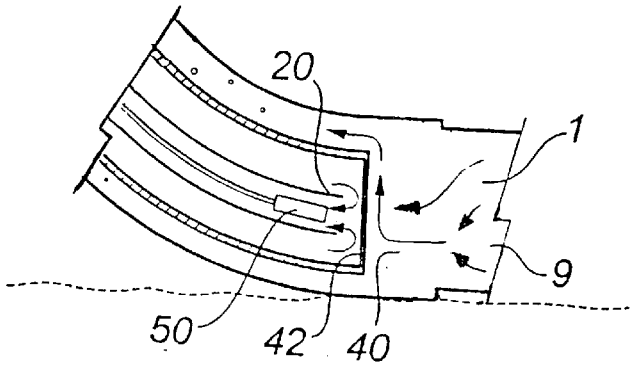
FIG. 6 illustrates a partial view of an alternate embodiment according to FIG. 4, wherein the production tubing string and packer are eliminated.

Further, in FIG. 6, conduit 12 and packer 15 can be eliminated entirely if fluid can be produced directly from the liner without using a production tubing string. Formation fluids flow then, directly from the liner, into the outer annulus which extends from the bottom of the tubing to the wellhead.

In FIGS. 1 and 2, it is possible to use the production well to inject steam into the formation for periods of time by injecting steam down the first conduit 12 with flow through the wellhead outlets 24 and 21 closed off. Optionally, a low rate of blanket gas can be injected into the annulus 16 through outlet 24 while steam is injected into the first conduit 12. The downhole pump 50 can be left in place during this steam injection period.

In FIGS. 1 and 2, if the formation pressure alternates between high and low values, one option is to produce formation fluids to the surface in the first conduit 12 during high pressure periods while the wellhead outlets 24 and 21 are closed off, then produce formation fluids to the surface through the second conduit 19, as per the method of this invention, during low pressure periods. The downhole pump 50 can be left in place even while the formation pressure is high.

If sand accumulates in the annulus 16 in FIG. 1, a sand cleanout device can be inserted through the second conduit 19. If sand accumulates in the annulus 16 in FIG. 2, a sand cleanout device can be inserted through the second conduit 19 if the pump 50 is removed, or through another opening in the wellhead. If sand accumulates in the liner 7 in FIGS. 1 or 2, a sand cleanout device can be inserted through the first conduit 12, particularly if the first conduit 12 does not extend very far into the liner.

As the gas-phase fluid 26 consists mainly of steam, it contains significant enthalpy. Surface recovery of this heat through heat exchangers and recycling or disposal of the fluid should be easier than if the produced fluid did not have split production. Further, the liquid-phase fluid 27 can result in considerable savings in the surface facilities. The lower temperature fluid 27 requires less cooling, and its reduced water content reduces the amount of separation and treating facilities required.

The invention may be retrofitted into a SAGD operation. During start-up of a SAGD injection-production well pair, steam circulation may initially be required at each well. This is accomplished by completing the horizontal production well with no annular packer and the first conduit is not yet fitted with a port. First conduit insulation is not necessary if heat loss is reduced using a gas blanket by injecting non-condensable gas through the annulus. During the SAGD start-up, steam is first injected through the first conduit, and return fluid is produced up through the second conduit. If most of the first conduit is insulated during start-up, the return fluid could be directed up the annulus. At the end of the start-up after hydraulic communication is achieved between the production well and the injection well, the steam chamber is very small, and it is not difficult to do a workover on the production well to set the packer and form the port by perforating, cutting, moving a sleeve, replacing the conduit, or by other means.

The invention may be applied to a single well SAGD operation in which the well is used for both steam injection and fluid production. As applied to the embodiment in FIG. 1, an additional tubing string is inserted into the annulus adjacent the first and second conduits. The additional tubing string extends from the wellhead into the formation. The tubing is thermally insulated from the surface to the elevation of the packer. Thus, the steam injection tubing string and the first conduit both pass through the packer and into the formation.

Advantages associated with the present invention include:

lifting fluid from thermal wells where the formation pressures are too low and the conditions too close to saturated steam conditions to use conventional artificial lift;

lifting fluid from a well having large quantities of multiphase fluid, where the gas phase interferes with downhole pumping efficiency, including the production wells of combustion processes;

increased flexibility, by enabling use of conventional artificial lift to be applied to portions of the well where they could not be successfully used previously;

ease of application due to flexibility in the positioning of the first conduit-to-annulus port and freedom to move the port in response to changes in formation conditions;

where the formation pressure is too high, and conventional lift methods would lead to problematic high pressures and temperatures at the surface, use of the method of the invention, without artificial lift applied to the second conduit, would provide a beneficial reduction in pressure and temperature at the surface; and geysering effects or slug flow can be dampened by using the relatively large annulus as an accumulator.

The embodiments of the invention in which an exclusive property or privilege is claimed are defined as follows:

1. Apparatus for producing fluid from a wellbore, the wellbore extending downwardly from a wellhead and into a hot subterranean formation and having completion intervals within the formation for admitting fluid to the wellbore, the formation fluid containing water at temperatures above 100° C., and comprising a first passageway extending along the wellbore and having an upper outlet at the wellhead and a lower end blocked above the completion intervals for containing a liquid pool therein, a second passageway having bottom inlet open to the formation; and a third passageway extending along the first passageway and having a lower liquid inlet located in the liquid pool and an upper outlet at the top of the wellbore, comprising:

(a) an upper port located in the second passageway and at an elevation intermediate along the wellbore for fluid communication to the first passageway, the elevation of the port being higher than the elevation at which water in the rising formation fluid begins to flash to steam;

(b) thermal insulation positioned between the first and second passageways and extending substantially between the first passageway's blocked lower end and the second passageway's port;

(c) means for producing fluid from the first passageway's upper outlet; and (d) means for producing fluid from the third passageway's upper outlet for lifting liquid phase fluid from the liquid pool so that, when fluid is produced from the upper outlets of both the first and third passageways, formation fluid enters the second passageway's bottom inlet and rises therethrough, the hydrostatic head on the formation fluid falling as it rises, the contained water flashing and the fluids cooling, the cooled fluid flowing out of the second passageway's port and into the first passageway where the cooled fluid separates into a substantially gas-phase fluid which flows up the first passageway for production from the first passageway's upper outlet and a substantially liquid-phase fluid which flows down the first passageway into the liquid pool.

2. The apparatus as recited in claim 1 further comprising:

means for blocking the wellbore above the completion intervals;

a first conduit extending along the wellbore and forming an annulus therebetween, the annulus forming the first passageway, the first conduit having a bore forming the second passageway and having a lower end extending through the blocking means so that the liquid pool forms in the annulus; and a second conduit extending along the annulus, the second conduit having a bore forming the third passageway.

3. The apparatus as recited in claim 2 wherein the means for producing fluid from the the annulus comprises a first fluid choke fitted to the first passageway's upper outlet, and the means for producing fluid from the liquid pool further comprises a second fluid choke fitted to the third passageway's upper outlet.

4. The apparatus as recited in claim 2 or 3 further comprising means for introducing gas into the second conduit for artificially lifting the liquid-phase fluid.

5. The apparatus as recited in claim 2 or 3 further comprising a pump installed within the second conduit and immersed within the liquid pool for artificially lifting the liquid-phase fluid.

6. The apparatus as recited in claim 2 wherein:

a casing forms the wellbore, the first conduit is a first tubing string extending through the casing for forming the annulus therebetween and the blocking means is a packer, the liquid pool forming in the annulus above the packer, and the first tubing further extending through the packer and into the formation;

the second conduit is a second tubing string extending through the annulus and into the liquid pool;

the upper port is formed in the first tubing string for fluid communication between the bore of the first tubing string and the annulus; and the thermal insulation is positioned between the first tubing string and the annulus.

7. The apparatus as recited in claim 6 wherein:

a first fluid choke is fitted to the upper outlet of the annulus, and a second fluid choke is fitted to upper outlet of the first tubing string.

8. The apparatus as recited in claims 6 or 7 further comprising means for introducing gas into the second tubing string for artificially lifting the liquid-phase fluid.

9. The apparatus as recited in claims 6 or 7 further comprising a pump installed within the second tubing string and immersed within the liquid pool for artificially lifting the liquid-phase fluid.

10. The apparatus as recited in claim 1 further comprising:

a first conduit extending along the wellbore and forming an annulus therebetween, the annulus forming the second passageway, the first conduit having a bore forming the first passageway, the bore being blocked at the lower end so that the liquid pool forms therein; and a second conduit extending along the bore of the first conduit, the second conduit having a bore forming the third passageway.

11. A method of producing fluid from a wellbore extending downwardly from a wellhead and into a hot subterranean formation, the wellbore having completion intervals within the formation for admitting fluid, the formation fluid containing water at temperatures above 100° C., the wellbore having three passageways therein, the passageways having three parallel and co-extensive bores, the bore of the first passageway being blocked at a lower end above the completion intervals for blocking the entrance of formation fluid and having an upper outlet at the wellhead, the bore of the second passageway having a bottom inlet for admitting formation fluid, the bore of the third passageway having a bottom liquid inlet in fluid communication with the first passageway's lower end for admitting fluid therefrom, and having an upper outlet at the wellhead, the method comprising the steps of:

(a) providing a port located in the second passageway and at an elevation intermediate along the wellbore for fluid communication to the first passageway, the elevation of the port being higher than the elevation at which water in the rising formation fluid begins to flash to steam;

(b) thermally insulating the second passageway substantially between its port and the first passageway's blocked lower end;

(c) flowing hot fluid from the formation into the bore of the second passageway's lower inlet;

(d) elevating the hot formation fluid through the bore of the insulated second passageway at least until the pressure of the formation fluid reaches the saturated steam pressure, causing contained water to begin to flash to steam and causing the fluid temperature to cool as the hot formation fluid continues to elevate and the pressure continues to fall;

(e) discharging cooled formation fluid from the second passageway's port and into the bore of the first passageway, where the fluid separates into a substantially gas-phase fluid which flows up the bore of the first passageway and substantially liquid-phase fluid which flows down the bore of the first passageway to establish a liquid pool in the first passageway's blocked lower end;

(f) producing substantially gas-phase fluid from the first passageway's upper outlet; and (g) lifting fluid from the liquid pool by conducting the fluid from the liquid pool up the bore of the third passageway to the wellhead so as to produce substantially liquid-phase fluid from the third passageway's upper outlet.

12. The method as recited in claim 11 wherein the substantially liquid-phase fluid is produced from the third passageway by artificially lifting the liquid-phase fluid through a lift-conduit having a bore, the bore of the lift-conduit forming the third passageway and extending downwardly through the bore of the first passageway and into the liquid pool, for conducting the liquid-phase fluid upwardly and out of the wellhead.

13. The method as recited in claim 12 wherein the liquid-phase fluid is artificially lifted using gas-lift.

14. The method as recited in claim 12 wherein the liquid-phase fluid is artificially lifted by pumping.

15. The method as recited in claim 11 wherein the flow of hot formation fluid is controlled by adjusting the rate of flow of gas-phase fluid produced from the first passageway's upper outlet, and the level of the liquid pool is controlled by adjusting the rate of liquid-phase fluid flow produced from the liquid pool.

16. The method as recited in claim 11 wherein the flow of hot formation fluid is controlled by adjusting the rate of flow of liquid-phase fluid produced from the liquid pool, and the level of the liquid pool is controlled by adjusting the rate of gas-phase fluid flow produced from the first passageway's upper outlet.

17. The method as recited in claim 11 wherein the flow of hot formation fluid is controlled by adjusting the rate of flow of gas-phase fluid from the first passageway's upper outlet so as to maintain the temperature of the formation fluid entering the well at a predetermined temperature at or below the saturated steam temperature, and the level of the liquid pool is controlled by adjusting the rate of liquid-phase fluid flow produced from the liquid pool.

18. The method as recited in claim 11 wherein the flow of hot formation fluid is controlled by adjusting the rate of flow of liquid-phase fluid from the liquid pool so as maintain the temperature of the formation fluid entering the wellbore at a predetermined temperature at or below the saturated steam temperature, and the level of the liquid pool is controlled by adjusting the rate of gas-phase fluid flow produced from the first passageway's upper outlet.

19. The method as recited in claim 15, 16, 17, or 18 wherein the level of the liquid pool is controlled by determining the liquid-phase fluid pressure at a known elevation in the liquid pool; and calculating the difference between the pressure in the gas-phase fluid at first passageway's upper outlet and the pressure in the liquid pool for determining the level.

20. The method as recited in claims 11, 12, 13 or 14 wherein the wellbore is a horizontal well.

21. The method as recited in claims 11, 12, 13 or 14 wherein the formation fluid originates from a SAGD process.

22. The method as recited in claims 11, 12, 13 or 14 wherein the formation fluid originates from a combustion process.

23. The method as recited in claim 11, 12 wherein elevating of the formation fluid in the second passageway is assisted with gas-lift.

24. The method as recited in claim 11 further comprising the steps of providing a gas-injection conduit for discharge at one or more locations within the third passageway;

injecting gas through the gas-injection conduit for gas lifting the liquid phase of the fluid up the third passageway for production from the third passageway's upper outlet as a liquid product.

25. The method as recited in claim 11 further comprising the steps of providing a fluid pump within the liquid pool;

pumping the liquid-phase fluid up the lift-conduit for production from the third passageway's upper outlet as the liquid product.

26. The method as recited in claims 24 or 25 further comprising controlling the rate of fluid flow out of the first passageway's upper outlet for controlling the rate of production of fluid from the formation; and controlling the rate of fluid flow from the liquid pool, for controlling the level of the liquid pool below the port.

27. The method as recited in claims 24 or 25 further comprising controlling the rate of fluid flow from the liquid pool for controlling the rate of production of fluid from the formation; and controlling the rate of fluid flow out of the first passageway's upper outlet for maintaining the level of the liquid pool below the port.

28. The method as recited in claims 24 or 25 further comprising the steps of controlling the rate of fluid flow from the first passageway's upper outlet so as to maintain the temperature of the formation fluid at a predetermined value which is lower than the saturated steam temperature of the fluid at the fluid conditions present at the second passageway's bottom inlet; and controlling the rate of fluid flow from the liquid pool for maintaining its level below the port.

29. The method as recited in claims 24 or 25 wherein the wellbore is a horizontal well.

30. The method as recited in claims 24 or 25 wherein the formation fluid originates from a SAGD process.

31. The method as recited in claims 24 or 25 wherein the formation fluid originates from a combustion process.

32. The method as recited in claim 11 further comprising the step of lowering the elevation of the second passageway's port as the pressure in the formation falls.

33. The method as recited in claim 32 wherein the elevation of the port is lowered by opening one of a plurality of successively lower ports.

34. The method as recited in claim 33 wherein only one of the plurality of ports is open to the first passageway at a time.

35. Apparatus for producing fluid from a wellbore, the wellbore extending downwardly from a wellhead and into a hot subterranean formation and having completion intervals within the formation for admitting fluid, the formation fluid containing water at temperatures above 100° C., comprising:

means within the wellbore, located above the completion intervals, for blocking formation fluid from flowing up the wellbore, an outer annulus being formed within the wellbore extending between the wellhead at the top of the outer annulus and the blocking means at the bottom of the outer annulus;

a first conduit extending through the wellbore, from an inlet located in the formation, through the blocking means and to a discharge located just within the outer annulus;

a large diameter tubing having a top outlet at top of the outer annulus and extending downwardly through the outer annulus, terminating with a closed end at the bottom of the outer annulus, the tubing having a fluid entrance port, the elevation of the entrance port being higher than the elevation at which water in the formation fluid begins to flash to steam;

a second conduit extending through the tubing and forming an inner annulus therebetween, the bottom of the inner annulus being formed by the closed bottom of the tubing and the top of which is formed by the wellhead, the second conduit having a bottom inlet located in a liquid pool, located in the inner annulus at an elevation below the tubing's entrance port, and having a top outlet extending through the top of the inner annulus;

thermal insulation extending substantially along the length of the tubing between the tubing's closed end and the tubing's entrance port;

means for producing fluid from the top of the annulus; and means for producing fluid from the top outlet of the second conduit for lifting liquid phase fluid from the liquid pool so that when fluid is produced from both the top of the inner annulus and from the top of the second conduit, and formation fluid enters the first conduit's inlet and rises through the outer annulus, the hydrostatic head on the formation fluid falling as it rises and causing contained water to begin to flash and the fluid to cool, the cooled fluid flowing through the tubing's entrance into the inner annulus where the cooled fluid separates into a substantially gas-phase fluid which flows up the inner annulus for production from the top of the inner annulus, and a substantially liquid-phase fluid which flows down the inner annulus into the liquid pool.

36. The apparatus as recited in claim 35 further comprising means for introducing gas into the second conduit for artificially lifting the liquid-phase fluid from the liquid pool to the top outlet of the second conduit and producing it therefrom.

37. The apparatus as recited in claim 35 further comprising a pump installed within the second conduit and immersed within the liquid pool for artificially lifting the liquid-phase fluid to the top outlet of the second conduit.

38. The apparatus as recited in claim 35, 36, or 37 wherein:

the blocking means and the first conduit are omitted, and formation fluid flows directly into the outer annulus which extends from the bottom of the tubing to the wellhead.

* * * * *

UNITED STATES PATENT AND TRADEMARK OFFICE

CERTIFICATE OF CORRECTION

PATENT NO. : 6,039,121
DATED : March 21, 2000
INVENTORS : Kisman

It is certified that error appears in the above-identified patent and that said Letters Patent are hereby corrected as shown below:

On the first page in the Abstract please insert

– Apparatus and method are provided for producing fluid from a wellbore –

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*